US005920051A

United States Patent [19]

Burri

[11] Patent Number: 5,920,051

[45] Date of Patent: Jul. 6, 1999

[54] COMPRESSED-GAS CUTOUT HAVING A DISCONNECTING BRAKING STRUCTURE

[75] Inventor: Jürg Burri, Unterentfelden, Switzerland

[73] Assignee: GEC Alstom T & D SA, Oberebtfelder, Switzerland

[21] Appl. No.: 08/867,881

[22] Filed: Jun. 3, 1997

[30] Foreign Application Priority Data

Jun. 4, 1996 [EP] European Pat. Off. ..... 96108917

[51] Int. Cl.[6] ..... H01H 33/18; H01H 3/00

[52] U.S. Cl. ..... 218/43; 218/154

[58] Field of Search ..... 218/43, 65, 67, 218/57, 59, 78, 84, 154, 60

[56] References Cited

U.S. PATENT DOCUMENTS

| | | | |
|---|---|---|---|
| 2,233,605 | 3/1941 | Gunther . | |
| 4,229,632 | 10/1980 | Hertz et al. | 200/148 A |
| 4,973,806 | 11/1990 | Kirhcesch et al. | 200/148 F |
| 5,578,806 | 11/1996 | Houfbauer et al. | 218/59 |

FOREIGN PATENT DOCUMENTS

| | | |
|---|---|---|
| 1045511 | 12/1958 | Germany . |
| 92109439 U | 7/1992 | Germany . |
| 4116314A1 | 11/1992 | Germany . |

*Primary Examiner*—Wynn Wood Coggins
*Assistant Examiner*—Michael J. Hayes
*Attorney, Agent, or Firm*—Sughrue, Mion, Zinn, Macpeak & Seas, PLLC

[57] ABSTRACT

A drive rod (15) connects a moveable contact element (10) of a compressed-gas cutout (1) with a drive (20). A disconnecting braking structure (22) is provided for braking the drive rod (15) and the switch parts moved with the latter in the final phase of a disconnecting action. The disconnecting braking structure (22) comprises a track (48, 49, 50) assigned to the drive rod (15) and an adjustable guided roller (42 or 43) cooperating with the track (48, 49, 50) against the force of a spring (47). The track (48, 49, 50) has two track sections (48, 49), that are arranged parallel to a switch axis (y) and in tandem, whereas the top track section (49) has a greater distance to the switch axis (y) than the bottom track section (48), and a connecting section (50). The rollers (42 or 43) are pressed back at the disconnecting movement of the drive rod (15) against the force of the spring (47) while simultaneously exerting braking force on the drive rod (15). The potential energy of the spring (47) is utilized for acceleration in a subsequent connecting action.

13 Claims, 2 Drawing Sheets

COMPRESSED-GAS CUTOUT HAVING A DISCONNECTING BRAKING STRUCTURE

BACKGROUND OF THE INVENTION

The invention relates to a compressed-gas cutout, especially for high voltage, with a fixed contact element and a movable contact element interacting with the latter, a drive rod connecting the movable contact element with a drive, and a disconnecting braking structure for braking the disconnecting movement of the drive rod, as well as a disconnecting braking structure for a compressed-gas cutout, especially for high voltage.

A compressed-gas cutout of this type is known from European patent application no. 95120347.0. It refers to a so-called blast piston switch, where a blast piston moves with a blast cylinder in the final phase of a disconnecting action. Whereas in the case of compressed-gas cutouts with fixed blast pistons, towards the end of the disconnecting stroke the residual gas in the piston-cylinder-system forms a gas cushion that supports the braking of the moved masses, the residual gas cannot be used for braking the moved masses in blast piston switches. Thus, a pneumatic disconnecting arrangement is used for the compressed-gas cutout pursuant to European patent application no. 95120347.0. The disconnecting braking arrangement contains a braking piston that is loosely arranged on the drive rod and that is entrained by a stop in the end section. These brakes have a low overall height and they are therefore well suited for installation in the limited space that is available in the switch chamber. They have the disadvantage that they have to be produced with particularly narrow tolerances and that the energy that is converted into heat during the braking action is no longer available for a following connecting action.

The use of a hydraulic brake for a compressed-gas cutout is known from DE-C-32 15 243. Due to the high viscosity of the flow medium, the demands regarding the tolerances during production of a hydraulic brake are less than those for a pneumatic brake. This solution, however, has the disadvantage that not only the insulating gas but another medium has to be monitored, namely the hydraulic fluid, and above all, this monitoring takes place in a location that is difficult to access. In the case of a hydraulic brake, the brake energy is also lost after the disconnecting action.

Finally, from DE-A 41 16 314 a brake is known that is based on friction. This brake is also not suitable for a compressed-gas cutout, because friction results in abrasion, i.e., fine, possibly metallic powder that can adversely affect the insulation capability of the insulating gas. Furthermore, as with pneumatic and hydraulic brakes, the brake energy is lost after a disconnecting action.

SUMMARY OF THE INVENTION

An object of this invention is to design a compressed-gas cutout, especially for high voltage, with a disconnecting braking structure, and to design a disconnecting braking structure that allows the brake energy to be recovered, at least partially, for the connecting action, and where the disconnecting braking structure can be produced without adhering to narrow tolerances.

According to the invention, this object is achieved by a compressed-gas cutout with a fixed contact element, a movable contact element interacting with the latter, a drive rod connecting the movable contact element with a drive, and a disconnecting braking structure for braking the disconnecting movement of the drive rod. The device includes a track assigned to the drive rod and a moveable roller cooperating with the track against to the force of a spring. The track has two track sections that are arranged parallel to a switch axis (y) and in tandem, the track section which faces the contact side has a greater distance to the switch axis than the track section facing the drive side, and the two track sections are connected with each other by means of a connecting section that presses the rollers back at the disconnecting movement of the drive rod against the force of the spring while simultaneously exerting braking force on the drive rod.

Regarding the compressed-gas cutout according to the invention, and by means of the disconnecting braking structure according to the invention, part of the kinetic energy is converted into potential energy by the springs contained in the disconnecting braking structure during braking of the drive rod and the switch parts moved with the latter; this potential energy is used during connecting action for the additional acceleration of the drive rod and the switch parts moved with the latter. It is particularly advantageous, that the disconnecting braking structure according to the invention neither contains a medium that has to be refilled and monitored in addition to the insulating gas, nor parts generating abrasion.

Preferred embodiments of the compressed-gas cutout according to the invention are defined in the appended claims.

BRIEF DESCRIPTION OF THE DRAWING

The invention will be more clearly understood from the following description of an exemplary embodiment in conjunction with the accompanying drawings, wherein.

DETAILED DESCRIPTION OF THE INVENTION

Figure 1:
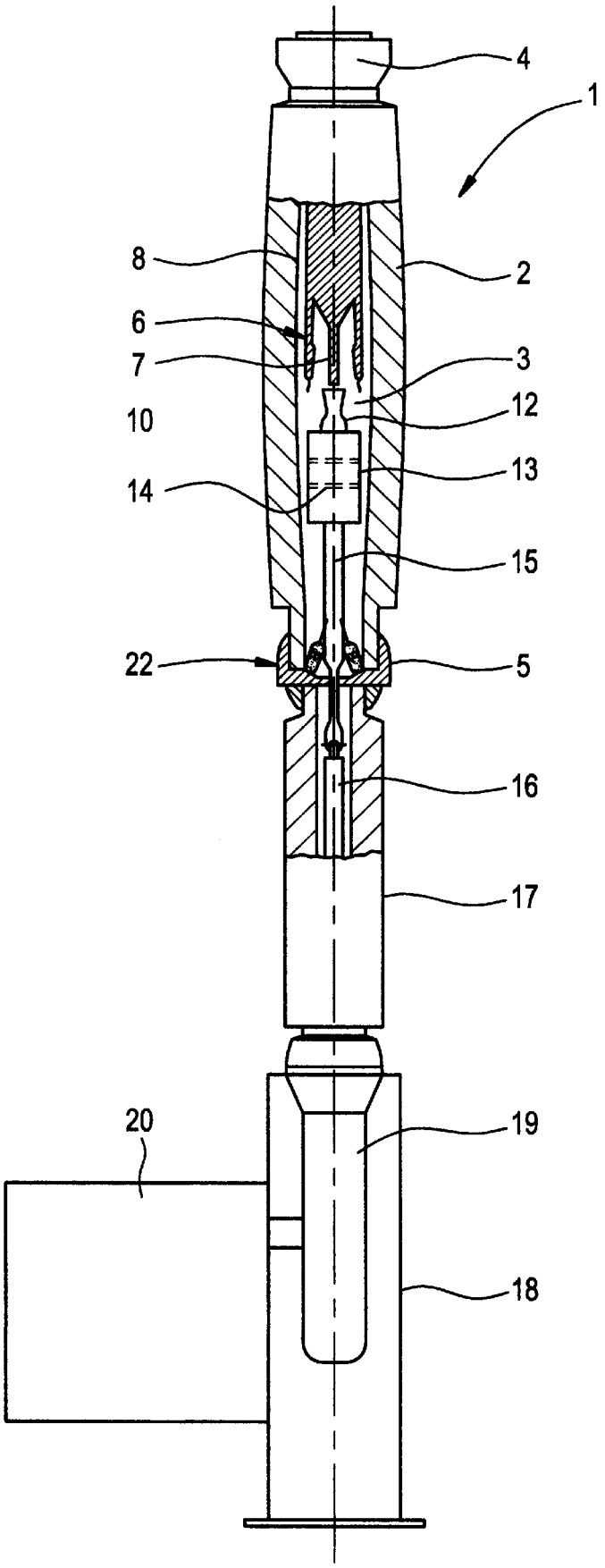
FIG. 1 schematically shows a compressed-gas cutout in view and partly in section, with an integrated disconnecting braking structure.

According to FIG. 1., the compressed-gas cutout 1 has a switch chamber 3 limited by a switch chamber insulator 2. On the top and on the bottom, switch chamber insulator 2 is connected with the connecting flange 4, 5. Top connecting flange 4 is connected with the fixed contact element 6, which has a consumption contact piece 7 and the constant current contact piece 8. Fixed consumption contact piece 7 cooperates with the moveable contact element 10. Compressed-gas cutout 1 is embodied as a blast piston switch; a blast cylinder, axially-moveable with moveable contact element 10, the former having a blast nozzle 12, is shown in FIG. 1 only symbolically and is designated as 13. The blast cylinder cooperates with constant current contact piece 8 when the switch is in the connecting position. For example, the design and functionality of the blast piston switch is described in detail in earlier European patent applications no. 94109470.8 and no. 95120347.0, which are incorporated herein by reference. The axial movement of moveable contact element 10, blast cylinder 13 and the blast piston 14

(indicated by a dotted line) from a connecting position, in which moveable contact element 10 is in contact with fixed contact element 6, to a disconnecting position shown in FIG. 1 was achieved by the drive rod 15, which penetrates the bottom of connecting flange 5 and which is coupled to the actuating rod 16, the latter being made of insulating material and running inside the support insulation arrangement 17. Actuating rod 16 is connected to a drive 20 by means of a mechanism 19 that is not shown in detail and that is arranged in the housing 18.

Inside switch chamber 3 and support insulation arrangement 17 is insulating gas, preferably SF6, at a certain pressure compared to the environment.

The disconnecting braking structure 22 is disposed in switch chamber 3 at bottom connecting flange 5, which will now be described with reference to FIGS. 2 and 3.

Figure 2:
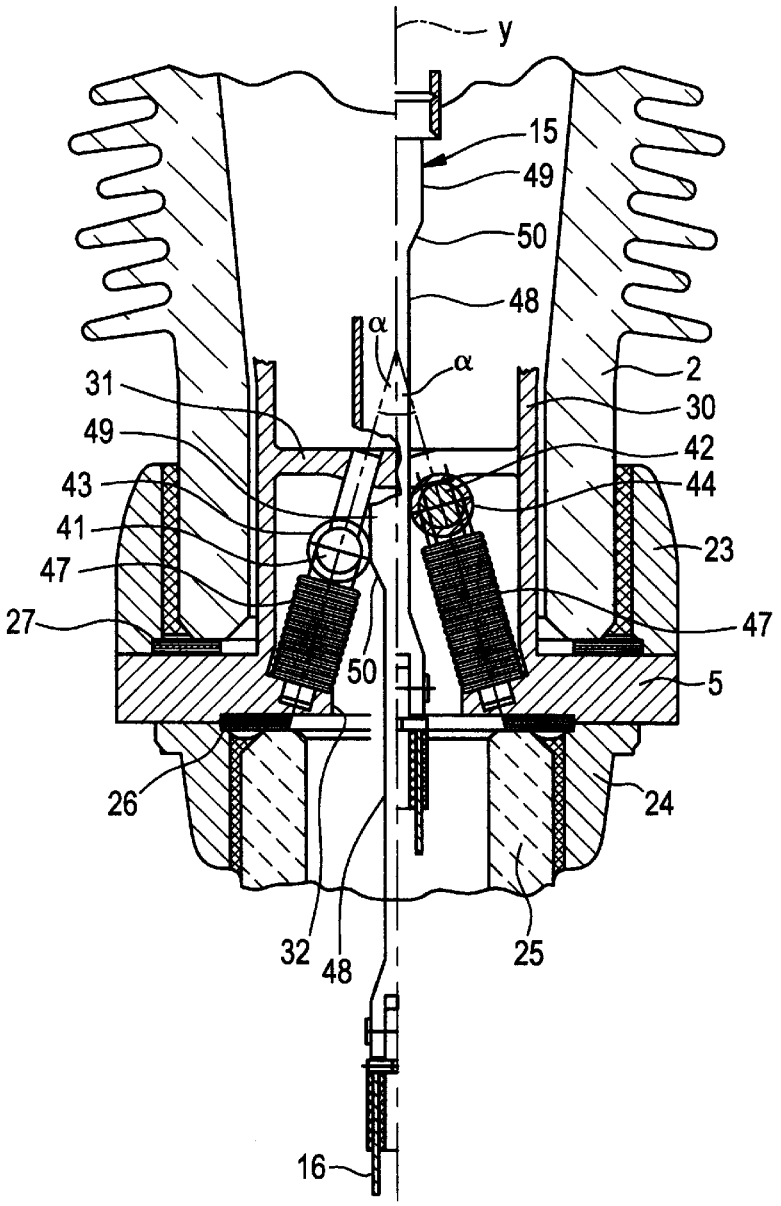
FIG. 2 illustrates a part of the compressed-gas cutout enlarged in comparison to FIG. 1 with the disconnecting braking structure in longitudinal section, whereby the left half of the disconnecting position of the compressed-gas cutout corresponds to the right of the connecting position.
Figure 3:
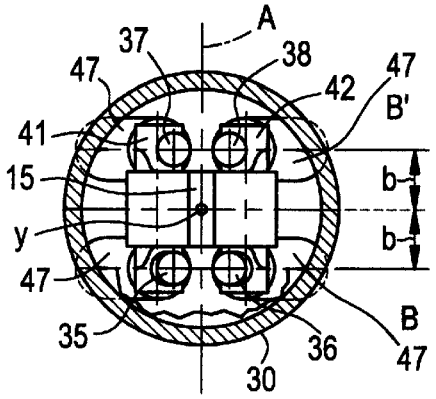
FIG. 3 depicts a part of the disconnecting braking structure according to FIG. 2 in top view and partly in section in the connecting position.

FIG. 2 shows the bottom end area of switch chamber insulator 2, that is coupled to connecting flange 5 by means of the mounting flange 23. Mounting flange 23 is screwed to connecting flange 5, which is not shown in detail in FIG. 2. Furthermore, connecting flange 5 is screwed to the other mounting flange 24, by means of which the mounting on the support insulator 25 of support insulation arrangement 17 is achieved. Switch chamber insulator 2 is permanently connected to mounting flange 23 and support insulator 25 with additional mounting flange 24 by means of a seal. The inside of support insulation arrangement 17 and switch chamber 3 are sealed towards the outside in the area of connecting flange 5 through the seals 26, 27.

According to FIG. 2, connecting flange 5 has a bushing-shaped part 30 protruding upward into switch chamber 3, which part has a transverse wall 31 serving as the support and bearing assembly of blast piston 14 with the part's top end section that is not shown. In FIG. 3, transverse wall 31 is not shown for better visibility. Transverse wall 31 is embodied such that axially moveable drive rod 15 can penetrate without obstruction.

Four guide rods 35, 36, 37, 38 are mounted in transverse wall 31 and in the bottom internal step 32 of connecting flange 5. Two guide rods each 35, 36 and 37, 38 are arranged symmetrically to an axial plane A (FIG. 3), in which the switch axis y also extends in a vertical direction, whereas the axes of each guide rod 35, 36, 37, 38 contain a sharp angle $\alpha$ with axial plane A, as is apparent from FIG. 2. Guide rod pairs 35, 36 and 37, 38 each lie in planes B, B' parallel to switch axis y, which planes are arranged at equidistance b from manometric switch axis y.

The roller bearings 41, 42 are arranged to be displaceable on guide rods 35, 37 or 36, 38 on one side of axial plane A. Each roller bearing 41, 42 has a freely turnable roller 43 and 44 run on bearings in the middle of guide rods 35, 37 and 36, 38, whereby rollers 43, 44 are intended to interact with centrally-disposed drive rod 15, as described in detail hereinafter.

Each guide rod 35, 36, 37, 38 is coaxially assigned to a spring 47, which is supported by corresponding roller bearing 41 or 42 on the one hand, and step 32 of connecting flange 5 on the other hand. Springs 47 are preferably designed as one or more concentrically-arranged spiral spring(s) or as disk spring assemblies.

Drive rod 15 is embodied gate-like in the bottom area penetrating disconnecting brake structure 22, and exhibits tracks that are arranged symmetrically with respect to axial plane A, each having the top track section 49 that is parallel to switch axis y at the contact side, and the bottom track section 48 that is also parallel to switch axis y at the drive side, and the connecting section 50 that is arranged diagonally between the top and bottom sections. The two track sections 49 are spaced further from switch axis y than are the lower track sections 48.

The following functionality results from the described design:

In the connecting position of compressed-gas cutout 1, in which moveable contact element 10 interacts with fixed contact element 6, drive rod 15 is in its top position. Rollers 43—pursuant to the right half of FIG. 2—sit closely to lower track sections 48 of drive rod 15. Springs 47 are at least partially unstressed.

If the disconnecting action is initiated from drive 20, drive rod 15 and with it, moveable contact element 10 and blast cylinder 13 with blast nozzle 12, are accelerated downwards with actuating rod 16. Disconnecting braking structure 22 allows this movement, except for the minimal roller friction loss between rollers 43, 44 and track sections 48, without braking effect, until the connecting sections 50 cooperate with rollers 43, 44. From this point on, via connecting sections 50 a force is exerted from drive rod 15 on rollers 43, 44, whereby a component of this force presses rollers 43, 44 apart on both sides while overcoming the force of springs 47. Part of the kinetic energy of the moved mass is converted into potential energy of springs 47. Drive rod 15 and switch parts moved with the latter are thus braked at the desired time. As soon as top track sections 49 that are parallel to drive rod 15 interact with rollers 43, 44, the braking action is completed and springs 47 exercise only minimal force on drive rod 15, which force corresponds to the rolling friction between rollers 43, 44 and track sections 49. The potential energy of springs 47, however, remains because rollers 43, 44 are pressed apart by track sections 49 making it impossible to relieve stress from springs 47.

If the connecting action is initiated from drive 20 and drive rod 15 is moved upward, the potential energy from springs 47 is released at the precise moment when connecting sections 50 reach rollers 43, 44 and are fastened by them, and springs 47, which are now released, accelerate the connecting movement of drive rod 15 with their force or the vertical component of this force, until bottom track sections 48 interact again with rollers 43, 44.

The vertical angle $\alpha$ for the inclination of guide rods 35, 36, 37 and 38 results in the compact shape of disconnecting braking structure 22, which is favorable for installation in compressed-gas cutout 1. Furthermore, springs 47 obtain an actual stroke that is as long as possible.

The braking and accelerating action of drive rod 15 can be influenced as desired by shaping connecting sections 50 appropriately.

Although the disconnecting braking structure according to the invention is especially intended for blast piston switches, the application for conventional compressed-gas cutouts with a fixed blast piston is also absolutely possible.

What is claimed is:

1. A compressed-gas cutout, especially for high voltage, comprising: a fixed contact element (6), a movable contact element (10) interacting with the fixed contact element, a drive rod (15) connecting the movable contact element (10) with a drive (20), and a disconnecting braking structure (22) for braking the disconnecting movement of the drive rod (15), said disconnecting braking structure having a track (48, 49, 50) on the drive rod (15) and a moveable roller (43 or 44) cooperating with the track (48, 49, 50) against the force of a spring (47), the track (48, 49, 50) having first and second track sections (48, 49) that are arranged parallel to a switch axis (y), the second track section (49) having a greater distance to the switch axis (y) than the first track section (48), the first and second track sections (48, 49) being connected with each other by means of a connecting section (50) that presses the (43 or 44) back at the disconnecting movement of the drive rod (15) against the force of the spring (47) while simultaneously exerting braking force on the drive rod (15).

2. The compressed-gas cutout as defined in claim 1, characterized in that the movable roller (43 or 44) are displaceably-guided on a guide rod, which is arranged at an angle ($\alpha$) with respect to the switch axis (Y).

3. The compressed-gas cutout as defined in claim 2, characterized in that the spring (47) is guided by the guide rod.

4. The compressed-gas cutout as defined in claim 2, wherein the spring (47) is coaxial with the guide rod.

5. The compressed-gas cutout as defined in claim 1, further comprising a second track (48, 49, 50), wherein the two tracks (48, 49, 50) are arranged symmetrically with respect to switch axis (y).

6. The compressed-gas cutout as defined in claim 5, further comprising a second movable roller (43 or 44) cooperating with said second track (48, 49, 50) against the force of a second spring (47), characterized in that the rollers (43, 44) assigned to the tracks (48, 49, 50) are pivoted at one roller bearing each (41, 42), whereby each roller bearing (41, 42) is arranged adjustably at two parallel guide rods (35, 37 and 36, 38) against the force of a respective one of the springs (47) arranged coaxially to one of the two parallel guide rods.

7. The compressed-gas cutout as defined in claim 1, wherein the first track section (48) is closer to the drive (20) than is the second track section (49).

8. The compressed-gas cutout as defined in claim 1, wherein the movable roller (43 or 44) includes an outer roller surface that is contacted only by the track (48, 49, 50) on the drive rod.

9. A disconnecting braking structure for a compressed-gas cutout, especially for high voltage, comprising: a track (48, 49, 50) on a drive rod (15) and an adjustably guided roller (43 or 44) cooperating with the track (48, 49, 50) against the force of a spring (47), the track (48, 49, 50) having first and second track sections (48, 49) that are arranged parallel to a switch axis (y), the second track section (49) having a greater distance to the switch axis (y) than the first track section (48), the first and second track sections (48, 49) being connected with each other by means of a connecting section (50) that presses the mavable roller (43 or 44) back at the disconnecting movement of the drive rod (15) against the force of the spring (47) while simultaneously exerting braking force on the drive rod (15).

10. The disconnecting braking structure as defined in claim 9, characterized in that the movable roller (43 or 44) is displaceably-guided on a guide rod, which is arranged at an angle ($\alpha$) with respect to the switch axis (y).

11. The disconnecting braking structure as defined in claim 10, wherein the spring (47) is coaxial with the guide rod.

12. The disconnecting braking structure as defined in claim 9, wherein the movable roller (43 or 44) includes an outer roller surface that is contacted only by the track (48, 49, 50) on the drive rod.

13. The disconnecting braking structure as defined in claim 6, further comprising a second track (48, 49, 50) wherein the two tracks (48, 49, 50) are arranged symmetrically with respect to switch axis (y).

* * * * *